US007158106B2

(12) United States Patent
Cok et al.

(10) Patent No.: US 7,158,106 B2
(45) Date of Patent: Jan. 2, 2007

(54) TEMPERATURE MEASUREMENT USING AN OLED DEVICE

(75) Inventors: Ronald S. Cok, Rochester, NY (US); Felipe A. Leon, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 115 days.

(21) Appl. No.: 11/034,032

(22) Filed: Jan. 12, 2005

(65) Prior Publication Data

US 2006/0152454 A1 Jul. 13, 2006

(51) Int. Cl.
*G09G 3/32* (2006.01)

(52) U.S. Cl. ..... 345/76; 345/82; 315/169.3

(58) Field of Classification Search ..... 345/76, 345/82; 315/169.3
See application file for complete search history.

(56) References Cited

U.S. PATENT DOCUMENTS

| | | | | |
|---|---|---|---|---|
| 5,775,811 | A | 7/1998 | Hiraoka et al. | 374/185 |
| 6,774,883 | B1 | 8/2004 | Mühlemann | 345/101 |
| 7,042,427 | B1 * | 5/2006 | Inukai | 345/77 |
| 7,079,091 | B1 * | 7/2006 | Kondakov et al. | 345/76 |
| 2004/0150590 | A1 | 8/2004 | Cok et al. | 345/76 |

* cited by examiner

*Primary Examiner*—David Vu
(74) *Attorney, Agent, or Firm*—Andrew J. Anderson

(57) ABSTRACT

An OLED device comprising: a) a substrate; b) one or more OLED element(s) formed on the substrate and having a common electrical connection for passing current through the OLED element(s); c) one or more transistor circuit(s) for controlling current passing through the OLED element(s); and d) a controller for measuring a current passing through the common electrical connection when the OLED element(s) and/or transistor circuit(s) are at an unknown temperature, for controlling the transistor circuit(s), and for comparing the current measured to an established current response determined under known OLED element(s) and/or transistor circuit(s) temperature conditions to determine the temperature of the OLED element(s) and/or transistor circuit(s).

20 Claims, 2 Drawing Sheets

TEMPERATURE MEASUREMENT USING AN OLED DEVICE

FIELD OF THE INVENTION

The present invention relates to solid-state flat-panel OLED devices, and more particularly to temperature measurement of the OLED device.

BACKGROUND OF THE INVENTION

Solid-state organic light emitting diode (OLED) image display devices are of great interest as a superior flat-panel digital display device and in solid-state lighting applications. These OLED devices utilize current passing through thin films of organic material to generate light. The color of light emitted and the efficiency of the energy conversion from current to light are determined by the composition of the organic thin-film material.

The OLED devices are not perfectly efficient and produce heat as a by-product of the energy conversion from current to light. As is well known, OLED materials degrade more rapidly in the presence of heat. Moreover, the thin-film transistors typically used to control OLED devices are sensitive to heat. Efficiency of the OLED materials can also be affected by temperature. Hence, there is a need to understand the temperature of an OLED device so that appropriate controls or corrections can be implemented to maximize the performance of an OLED device.

Thin-film temperature sensors are known in the prior art. For example, U.S. Pat. No. 6,774,883 entitled "Electro-optical display device with temperature detection and voltage correction" issued 20040810 describes a display device provided with a thin-film digital thermometer for sensing the temperature of the supporting plate of an electro-optical medium, for example, a liquid crystal display medium. U.S. Pat. No. 5,775,811 entitled "Temperature sensor system using a micro-crystalline semiconductor thin film" issued 19980707 describes a method for manufacturing a thin-film temperature-sensitive device. It is also known to apply such sensors to displays and LCDs. US20040150590 entitled "OLED display with aging compensation" by Cok et al published 20040805 describes an OLED display that includes a plurality of light emitting elements and a temperature measuring device located on the substrate.

While these methods are useful, the disclosures only describe measuring the temperature of a device at a single location. Applicants have demonstrated that OLED devices in operation can have a variable temperature across the substrate so that a measurement at a single location on the substrate may not correspond to the temperature elsewhere or to the average temperature. Indeed, given that the sensor is likely to be located at the periphery of the display, it is likely to be cooler than other locations on the display. Moreover, as described an additional circuit must be provided, reducing yields and potentially complicating the design layout of the OLED display.

There is a need therefore for an improved OLED device and method for the detection of temperature within an OLED device.

SUMMARY OF THE INVENTION

In accordance with one embodiment, the present invention is directed towards an OLED device, comprising: a) a substrate; b) one or more OLED element(s) formed on the substrate and having a common electrical connection for passing current through the OLED element(s); c) one or more transistor circuit(s) for controlling current passing through the OLED element(s); and d) a controller for measuring a current passing through the common electrical connection when the OLED element(s) and/or transistor circuit(s) are at an unknown temperature, for controlling the transistor circuit(s), and for comparing the current measured to an established current response determined under known OLED element(s) and/or transistor circuit(s) temperature conditions to determine the temperature of the OLED element(s) and/or transistor circuit(s).

In accordance with another embodiment, the present invention is directed towards a method for the detection of temperature of an OLED device, comprising: a) providing an OLED device by forming one or more OLED element(s) on a substrate and one or more transistor circuit(s) for controlling current passing through the OLED element(s), the OLED element(s) having a common electrical connection for passing current through the OLED element(s); b) providing a controller for measuring the current passing through the common electrical connection and for controlling the transistor circuit(s); c) driving the OLED element(s) with a known drive signal, and measuring a current passing through the common electrical connection; and d) comparing the measured current to an established OLED device current response determined under known OLED element(s) and/or transistor circuit(s) temperature conditions to determine the temperature of the OLED device.

ADVANTAGES

The advantages of this invention are an OLED device with improved temperature detection and simplified construction.

DETAILED DESCRIPTION OF THE INVENTION

Figure 1:
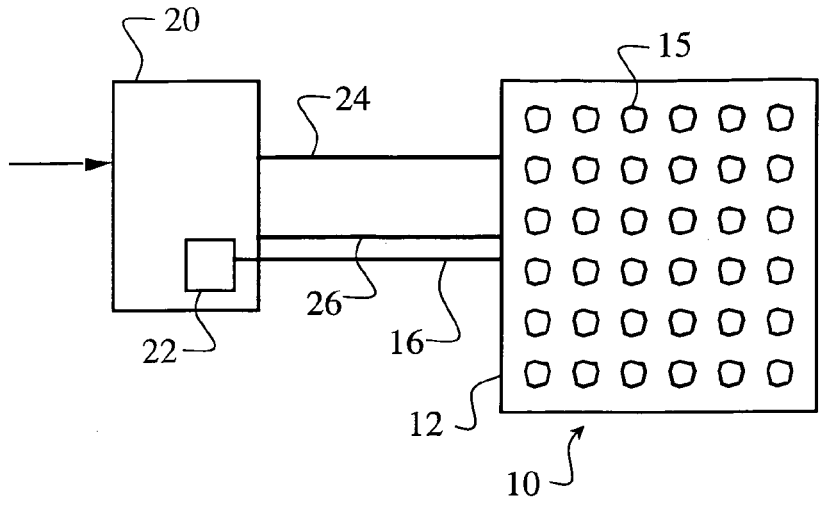
FIG. 1 is a schematic diagram of one embodiment of the present invention.
Figure 2:
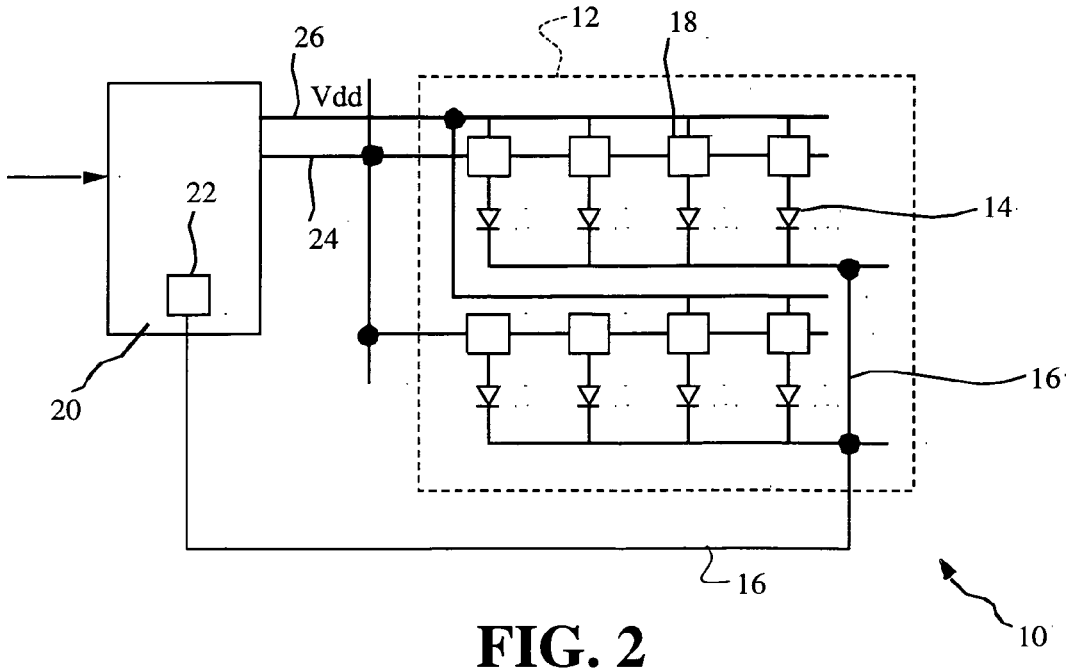
FIG. 2 is a more detailed schematic diagram of an embodiment of the present invention.
Figure 3:
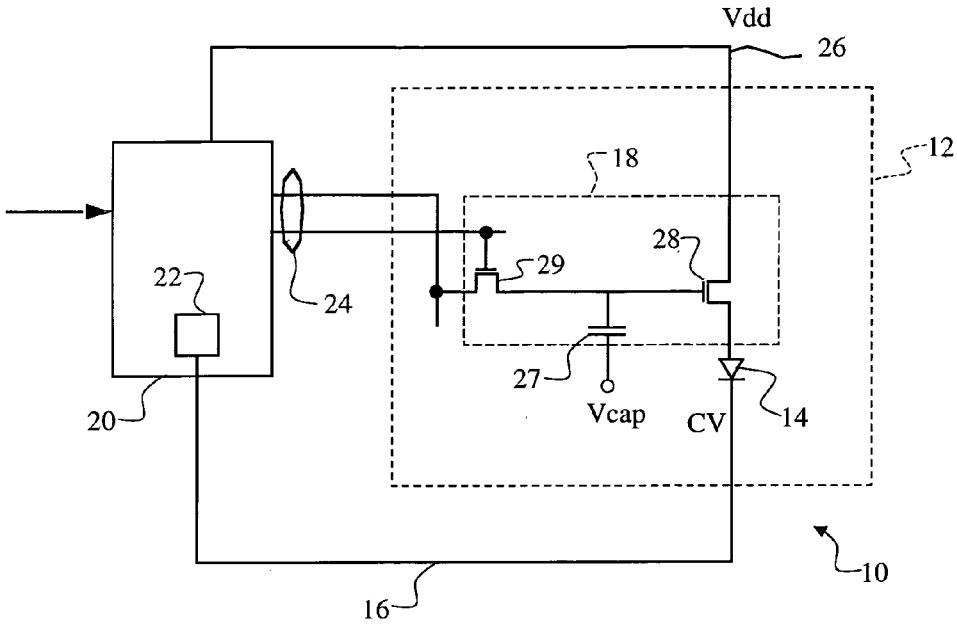
FIG. 3 is a further detailed schematic diagram of an embodiment of the present invention.

Referring to FIGS. 1, 2 and 3, one embodiment of an OLED device 10 according to the present invention comprises a substrate 12; one or more OLED element(s) 14 formed on the substrate 12 and having a common electrical connection 16 (and/or 26) for passing current through the OLED element(s) 14; one or more transistor circuit(s) 18 for controlling current passing through the OLED element(s) 14; a controller 20, for measuring current passing through the common electrical connection 16 when the OLED element(s) and/or transistor circuit(s) are at an unknown temperature, for controlling the transistor circuit(s) 18, and for comparing the current measured to an established current response determined under known OLED element(s) and/or transistor circuit(s) temperature conditions to determine the temperature of the OLED element(s) and/or transistor circuit(s).

The OLED device 10 may have one or more OLED elements 14 and the transistor circuit 18 may be integrated on the substrate 12 locally to an OLED element 14 to form a pixel 15 of an active-matrix OLED device. In this case, a plurality of pixels 15 may be distributed regularly over the surface of the substrate 12 as shown in FIG. 1 and may be employed in a display. Alternatively, while not shown, the transistor circuit(s) 18 may be integrated on the substrate 12 at the periphery of the OLED substrate 12 or externally to the substrate 12 in a passive-matrix configuration. Such a configuration is useful for displays and also for area illumination, for example in lamps.

FIG. 2 illustrates a plurality of transistor circuits 18 distributed over a portion of the substrate 12 for driving associated OLED element(s) 14 and connected to the controller 20 through control signals 24. An electrical connection for power signal 26 (Vdd) may be provided in common to every pixel 15 together with an electrical connection 16 for a ground or cathode voltage signal CV likewise connected in common to every pixel 15. The current passing through the common electrical connection 16 (or the power signal 26) may be measured by a current measuring device 22. The transistor circuits 18, OLED elements 14, controller 20, electrical connections 26 and 16, and a current measuring device 22 are all well known in the prior art.

FIG. 3 illustrates one of the one or more transistor circuits 18 for driving the OLED element(s) 14 and connected to the controller 20 through control signals 24 and power signals 16 and 26. As shown in FIG. 3, control signals 24 comprising data and select signals deposit charge on a capacitor 27 through a control transistor 29. The capacitor 27 is also connected to a driving transistor 28. The amount of charge deposited on the capacitor 27 controls the amount of current passing through the drive transistor 28 and the amount of light emitted from the OLED element 14. The transistor circuits 18 and its constituent components are all well known in the prior art.

Silicon transistors and circuit elements are known to behave differently at different temperatures. Likewise, the behavior of an OLED element changes at different temperatures, although much less significantly. Applicants have determined that, for a given control signal, when the transistor circuit(s) 18 and OLED element(s) 14 are operated at different temperatures a consistent, proportional and measurable change in current passing through the OLED results and may be measured through a common electrical connection to the OLED element(s), for example power signal-26 or signal 16. Silicon devices including polysilicon, amorphous silicon, continuous grain silicon, micro-crystalline silicon, or crystalline silicon circuits may respond in this way. Thin-film devices are known and may be employed for transistor circuit 18.

In a particular embodiment, the OLED device may comprise a display device, and the plurality of OLED elements 14 may define or be part of a display area. The present invention has the great advantage of not requiring any additional circuitry on the substrate 12 and of integrating the response due to temperature over the entire display area. The common electrical connections of the present invention may be the CV ground signal 16 typically connected to the cathode of the OLED element(s), or Vdd signal 26 that provides power to the OLED element(s) through drive transistor 28. Although signal 26 is not directly connected to OLED element(s) 14, it is considered a common electrical connection for the OLED element(s) 14 according to the present invention as it supplies power to all of the OLED elements in common. All these electrical connections are present in conventional OLED devices. The only additional circuitry required is a measurement circuit 22 for measuring the current used by the OLED element(s). Such a measurement circuit is readily integrated into a conventional controller using conventional designs and manufacturing processes known in the art. The construction of an OLED device is also known in the art. The present invention may be applied to a variety of transistor circuit designs, including both constant current source and constant voltage source transistor circuits.

According to the present invention, a method for the detection of temperature of an OLED device may include the steps of providing an OLED device 10 by forming one or more OLED element(s) 14 on a substrate 12 and one or more transistor circuit(s) 18 for controlling current passing through the OLED element(s) 14 having a common electrical connection 16 (and/or 26) for passing current through the OLED element(s) 14; providing a controller 20 for measuring the current passing through the common electrical connection and for controlling the transistor circuit(s) 18; driving the OLED element(s) 14 with a known drive signal, and measuring a current passing through the common electrical connection; and comparing the measured current to an established OLED device current response determined under known OLED element(s) and/or transistor circuit(s) temperature conditions to determine the temperature of the OLED device 10.

In operation, the OLED device 10 may be first calibrated to establish an OLED device current response by operating the device in a controlled environment with a pre-determined known test signal where the temperature of the device is directly measured with a temperature sensor (e.g., a thermocouple secured directly to the device). The device will output light in accordance with the known test signal, and will consume a varying amount of current dependent upon the device temperature. By changing the temperature of the controlled environment while monitoring the actual temperature of the device and measuring the current consumed, a current response for a variety of device temperatures may be established. The OLED device 10 may then be used for an application at an unknown device temperature. The OLED device is operated with the known test signal and a current measured. This measured current may be different from the current measured during calibration because of the effect of the temperature on the OLED element(s) 14 and transistor circuit(s) 18. The measured currents are compared in accordance with the established current response to determine the unknown temperature of the OLED device 10. The current measured by the current measuring device 22 will include all of the current from all of the OLED element(s) having a common electrical connection 16. Typically, all of the OLED elements on the OLED device are connected in common and are spread across most of the device substrate, thereby providing a great deal of current and a sensitive means to detect the average temperature of the OLED device.

As shown in FIG. 3, the common electrical connection 16 is labeled CV and connected directly to the OLED element cathode. However, other arrangements are possible, for example the common electrical connection could be the Vdd signal 26 used to provide power to the driving transistor 28 of the transistor circuit 18 and is not directly connected to the OLED element itself. As discussed above and used herein, a common electrical signal may refer to a single electrical signal that carries the current used to drive the OLED element(s) and is connected to either the transistor circuit 18 or OLED element 14. A variety of transistor circuits are known in the art, including, for example, constant current circuits, circuits designed to reduce dependence on transistor variability, time-based control, and circuits utilizing photo-sensitive elements to compensate for variability in OLED output.

Although the current measurement used to determine device temperature must be made with a known drive signal, the signal may be very short and may not be noticeable to a user. For example, a single frame of a video signal (1/30 or 1/60 seconds) may be employed. Moreover, the known signal may be dark and gray so as to be as unobtrusive as possible. The signal may be a flat-field or may be colored. The signal may be a part of a user interface, for example a start-up or shut-down screen, or may have icons that represent marketing information such as advertisements or corporate logos. Alternatively, if the overall characteristics of a drive signal over time are known (but a specific, instantaneous signal is unknown) the current may be measured as an average over time for such drive signal. In this case, no special test signal need be employed. This may be effective if the OLED device is employed to view video sequences. The average color and brightness of a video or sequence of still images is typically an 18% gray. If it is known that the drive signal is a video or still image sequence, such known average brightness and content (over time) for such signal may be used as an estimate, and a repeatable current measurement over time may be made. In yet another alternative, a specific known test signal may be employed by the device as part of its user interface, for example as part of a start-up or shut-down process splash screen or logo. In these cases, no additional known test signal need be employed.

Figure 4:
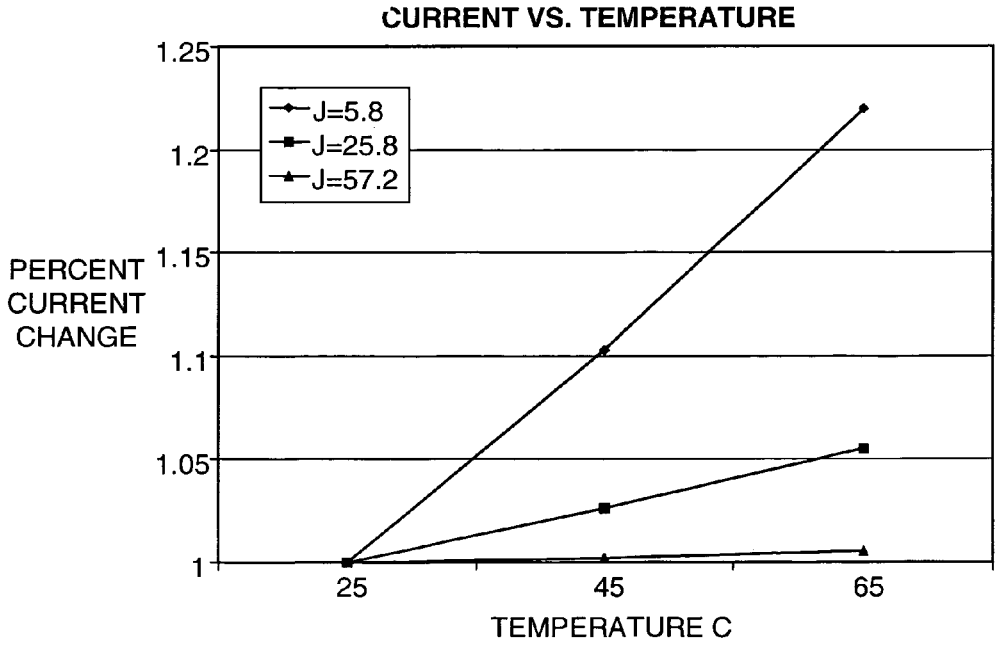
FIG. 4 is a graph illustrating the current response of an OLED device relative to device temperature for given drive signals.

Referring to FIG. 4, the response of the OLED device to variations in device temperature at a variety of initial current densities and with a given pre-determined constant signal is shown. The current response is normalized to response at a temperature of 25° C. in the graph. The increase in current due to increasing temperature is shown for 45° and 65° C. For example, as illustrated in FIG. 4, at a nominal current density of 25.8 ma/cm$^2$, the current increases by slightly more than 5% with a temperature increase of 40° C. from 25° C. to 65° C. Note that the percent increase in current is larger for smaller current densities. Hence, performing the measurement at lower current densities (darker images) may provide an improved signal-to-noise ratio if the signal is large enough to be readily measured. By measuring the current at a variety of temperatures, a complete curve such as that shown in FIG. 4 may be determined and a lookup table used to relate the current measurement to the temperature.

The construction of a lookup table may be performed as part of a factory calibration of an OLED device and may include determining the entire current response to a variety of temperatures by using multiple measurements or a single point on the curve determined and a typical curve employed to create the table. Alternatively, if the variability in OLED device performance is small enough to meet the requirements of a particular application, the established OLED device current response may be determined on a single device and the associated conversion table may be used for all subsequent similar devices. In this case, a functional transformation (possibly implemented with a lookup table) using the pre-established response may be provided in the controllers shipped with the OLED devices. Therefore, the calibration of the established OLED device current response to temperature may be measured for each device or for an exemplary device. Complete response curves may be determined for each OLED device or family of OLED devices, or single values used and typical performance curves employed.

Applicants have also determined that the ambient illumination incident on an OLED device can affect the current and brightness of an OLED device. This effect can be discounted by ensuring that the temperature is measured in a dark surround and/or by covering the OLED device to prevent the incidence of ambient light upon the transistor circuit(s) of the OLED device while driving the OLED element(s) with the known drive signal and measuring the current passing through the common electrical connection. Note that color filters, electrodes, and black matrix materials sometimes used with OLED devices may also be effective at obscuring ambient light.

It is important to note that OLED devices exhibit a significant amount of self-heating. Temperature readings taken at the same location within a few minutes of each other can be very different depending on the operation of the OLED device. This effect can be used to distinguish the ambient temperature and the operating temperature. For example, an initial reading taken shortly after a device is turned on, before the OLED device has been emitting large quantities of light, and using a dark known control signal can be presumed to be operating at ambient temperature, while a reading taken after the OLED device has been operating normally for some time may be presumed to represent the operating temperature of the device which may be significantly different from the surrounding ambient environment.

The transistor circuit can be manufactured using thin-film technology using silicon or organic semiconductors as is known in the art. The present invention may be used in both top- and bottom- emitting OLED structures. The use of top-emitting OLED devices may be particularly applicable to the present invention, as such devices typically employ opaque bottom electrodes which shield the transistor circuitry from ambient light, thereby minimizing the effect of ambient light on current measurements. While the invention is described above primarily in connection with OLED devices comprising a plurality of pixels, in an extreme case, an OLED device, e.g., a lamp, may comprise a single pixel, and the present invention is applicable thereto.

As noted above, OLED materials degrade more rapidly in the presence of heat, and the thin-film transistors typically used to control OLED devices are sensitive to heat. The present invention enables monitoring of the temperature of an OLED device so that appropriate controls or corrections can be implemented to maximize the performance of an OLED device. In a particular embodiment, aging of the OLED elements during their lifetimes may be conveniently estimated in response to the OLED device temperatures determined in accordance with the present invention.

In a preferred embodiment, the invention is employed in a device that includes Organic Light Emitting Diodes (OLEDs) which are composed of small molecule or polymeric OLEDs as disclosed in but not limited to U.S. Pat. No. 4,769,292, issued Sep. 6, 1988 to Tang et al., and U.S. Pat. No. 5,061,569, issued Oct. 29, 1991 to VanSlyke et al. Many combinations and variations of organic light emitting displays can be used to fabricate such a device.

The invention has been described in detail with particular reference to certain preferred embodiments thereof, but it will be understood that variations and modifications can be effected within the spirit and scope of the invention.

PARTS LIST

10 OLED device
12 substrate
14 OLED element
15 pixel
16 electrical connection
18 transistor circuit
20 controller
22 current measuring device
24 signal line(s)
26 electrical connection
27 capacitor
28 drive transistor
29 control transistor

The invention claimed is:

1. An OLED device, comprising:

a) a substrate;

b) one or more OLED element(s) formed on the substrate and having a common electrical connection for passing current through the OLED element(s);

c) one or more transistor circuit(s) for controlling current passing through the OLED element(s); and d) a controller for measuring a current passing through the common electrical connection when the OLED element(s) and/or transistor circuit(s) are at an unknown temperature, for controlling the transistor circuit(s), and for comparing the current measured to an established current response determined under known OLED element(s) and/or transistor circuit(s) temperature conditions to determine the temperature of the OLED element(s) and/or transistor circuit(s).

2. The OLED device claimed in claim 1, wherein the transistor circuit(s) are formed on the substrate.

3. The OLED device claimed in claim 2, wherein the OLED device is an active-matrix OLED device.

4. The OLED device claimed in claim 1, wherein the OLED device is a passive-matrix device.

5. The OLED device claimed in claim 1, wherein the OLED device is a lamp.

6. The OLED device claimed in claim 1, wherein the OLED device is a display.

7. The OLED device claimed in claim 1, wherein the transistor circuits are thin-film circuits.

8. The OLED device claimed in claim 1, wherein the transistor circuits are silicon circuits.

9. A method for the detection of temperature of an OLED device, comprising:

a) providing an OLED device by forming one or more OLED element(s) on a substrate and one or more transistor circuit(s) for controlling current passing through the OLED element(s), the OLED element(s) having a common electrical connection for passing current through the OLED element(s);

b) providing a controller for measuring the current passing through the common electrical connection and for controlling the transistor circuit(s);

c) driving the OLED element(s) with a known drive signal, and measuring a current passing through the common electrical connection; and d) comparing the measured current to an established OLED device current response determined under known OLED element(s) and/or transistor circuit(s) temperature conditions to determine the temperature of the OLED device.

10. The method of claim 9, wherein the established OLED device current response is determined by driving the OLED element(s) of the device with a known signal in a controlled environment while changing the temperature of the controlled environment, directly measuring the temperature of the device with a temperature sensor, and measuring the current passing through the common electrical connection of the OLED device at different measured temperatures.

11. The method of claim 9, wherein the established OLED device current response is determined by driving the OLED element(s) of a separate OLED device having one or more OLED element(s) having a common electrical connection and one or more transistor circuits for driving the OLED element(s) with a known signal in a controlled environment while changing the temperature of the controlled environment, directly measuring the temperature of the separate device with a temperature sensor, and measuring the current passing through the common electrical connection of the separate OLED device at different measured temperatures.

12. The method claimed in claim 9, wherein the established OLED device current response is used to determine a conversion function between current and device temperature prior to shipping the OLED device to a customer.

13. The method claimed in claim 12, wherein the conversion function is implemented as a lookup table.

14. The method claimed in claim 12, wherein the conversion function is incorporated into the controller and employed to convert measured currents to device temperature.

15. The method claimed in claim 9, wherein the drive signal in step c) is a gray flat-field signal, a colored flat-field signal, a graphic user interface signal, or iconic display signal.

16. The method claimed in claim 9, wherein the current measured in step c) is an average measured current over a period of time.

17. The method claimed in claim 9, wherein the drive signal in step c) is a known signal that is part of a user interface.

18. The method claimed in claim 9, wherein the current is measured after the OLED device is turned on and before the OLED elements are used to provide information.

19. The method claimed in claim 9, further comprising preventing the incidence of ambient light upon the transistor circuit(s) of the OLED device while driving the OLED element(s) with the known drive signal and measuring the current passing through the common electrical connection in step c).

20. The method of claim 9, further comprising estimating the aging of the OLED elements in response to the temperature of the OLED device determined in step d).

* * * * *